US008928549B2

(12) United States Patent
McDonnell

(10) Patent No.: US 8,928,549 B2
(45) Date of Patent: Jan. 6, 2015

(54) ANTENNA WINDOW BRACKET

(75) Inventor: Joshua M. McDonnell, East Norwich, NY (US)

(73) Assignee: HD Frequency, Inc., Fairfield, CT (US)

( * ) Notice: Subject to any disclaimer, the term of this patent is extended or adjusted under 35 U.S.C. 154(b) by 350 days.

(21) Appl. No.: 13/454,646

(22) Filed: Apr. 24, 2012

(65) Prior Publication Data

US 2012/0268341 A1 Oct. 25, 2012

Related U.S. Application Data

(60) Provisional application No. 61/478,514, filed on Apr. 24, 2011, provisional application No. 61/636,972, filed on Apr. 23, 2012.

(51) Int. Cl.
*H01Q 1/12* (2006.01)

(52) U.S. Cl.
CPC ..... *H01Q 1/1207* (2013.01); *H01Q 1/1221* (2013.01)
USPC ..... 343/895

(58) Field of Classification Search
USPC ..... 343/859, 880–883, 803, 725
See application file for complete search history.

(56) References Cited

U.S. PATENT DOCUMENTS

| | | | | |
|---|---|---|---|---|
| 3,511,106 | A | 5/1970 | Deeby | |
| 3,950,756 | A * | 4/1976 | Tisler | 343/766 |
| 4,099,185 | A | 7/1978 | Hacker et al. | |
| 5,524,856 | A * | 6/1996 | Neely et al. | 248/534 |
| 6,731,250 | B1 | 5/2004 | Berman | |
| 6,734,830 | B1 | 5/2004 | Bickham | |
| 6,980,092 | B2 * | 12/2005 | Turnbull et al. | 340/425.5 |
| 8,220,888 | B2 * | 7/2012 | Tamayama et al. | 312/405 |

* cited by examiner

*Primary Examiner* — Huedung Mancuso
(74) *Attorney, Agent, or Firm* — Carrie Stroup

(57) ABSTRACT

Disclosed herein is a portable antenna window bracket that securely supports a satellite dish or other over the air type antenna outside a window without the need to drill into or make permanent physical attachment to the window or structure surrounding the window. The portable antenna bracket allows an antenna mounted thereon to be positioned beneath the window, thereby maintaining a clear and unobstructed view through the window. An extender is provided with an antenna receiver and a bridge on distal and proximal ends of the extender, respectively, as well as an interior support of the bridge positioned opposite the extender. An extender support is also provided with first and second edges, with the second edge adapted to abut a surface beneath the window, to support antenna weight and stabilize the antenna bracket.

20 Claims, 5 Drawing Sheets

ANTENNA WINDOW BRACKET

PRIORITY

This application claims priority to application No. 61/478,514 filed with the U.S. Patent and Trademark Office on Apr. 24, 2011, and to application No. 61/636,972 filed with the U.S. Patent and Trademark Office on Apr. 23, 2012, which are incorporated by reference herein.

BACKGROUND OF THE INVENTION

1. Field of the Invention

The present invention relates generally to an apparatus and method for antenna mounting using a portable bracket that is mountable and dismountable without making a permanent attachment to a window within which the antenna is mounted and that allows reversible antenna positioning.

2. Brief Description of the Prior Art

U.S. Pat. No. 3,511,106 to Deeby discloses a window antenna mount with a control to remotely rotate an antenna mounted therein. Deeby teaches a window mount that includes a corner bracket that rests on a sill portion of a window. Deeby utilizes a corner bracket having horizontal and vertical corner braces that attach to respective sides of an exterior of the window by screwing into the window and/or clamping to the exterior windowsill.

U.S. Pat. No. 4,099,185 to Hacker et al. discloses an antenna support that is mountable on an exterior of a window and is adapted for use with a citizen's band antenna. Hacker et al. provides a bracing member that is secured within a window frame and includes a plurality of horizontal ground plane elements with a boom assembly having a supporting member with a mount section. However, the tensioning of the horizontal members between exterior sides of a window frame taught by Hacker et al. only allows for support of lightweight antennas.

U.S. Pat. No. 6,734,830 to Bickham discloses a portable adjustable stand for mounting and supporting a digital satellite dish antenna without the need to drill holes or to make a permanent physical attachment to a surface of a dwelling, such as by use of screws, bolts, or other fasteners. Bickham provides a stand having a pair of parallel laterally adjustable longitudinal bracket mounting members and a first and second transverse cross member. Bickham requires a horizontal support surface and is not usable in a window.

However, the securing arrangements of such conventional antenna mounts and brackets are incompatible to serve as window mounts, can support only lightweight antennas, or will damage windowsills, which is unacceptable to people who rent or have restricted ownership rights such as condominium or cooperative owners. In addition, conventional antenna brackets undesirably position the antenna in the line of sight that blocks a portion of the view from a window.

SUMMARY OF THE INVENTION

The present invention overcomes shortcomings of conventional devices by providing a portable apparatus that does not damage a window in which the apparatus is installed, and allows positioning of the antenna beneath a bottom windowsill so as to not impede a line of sight of a building occupant out of the window.

An object of the present invention is to provide a portable bracket installable in a window for mounting an antenna outside and beneath the window. The bracket includes an extender with a mast receiver and a bridge on respective distal and proximal ends thereof. The antenna bracket includes an interior support of the bridge positioned opposite the extender and at least one extender support. The extender support has a first edge and a second edge, with the second edge adapted to abut a surface beneath a window within which the bridge and interior support are positioned, to support the weight of an antenna, regardless of shape or size.

Another object of the present invention is to provide a window antenna bracket having an extender formed in a flat triangular shape provided on a first level thereof. A bridge is provided with a first edge at the first level and a second edge provided at a second level, with a predefined elevation separating the first level of the first edge from the second level of the second edge. A channel is formed in the bridge having a depth that matches the predefined elevation for positioning over a sill of a window to support and facilitate ease of installation of the bracket.

DESCRIPTION OF THE PREFERRED EMBODIMENTS

Figure 1:
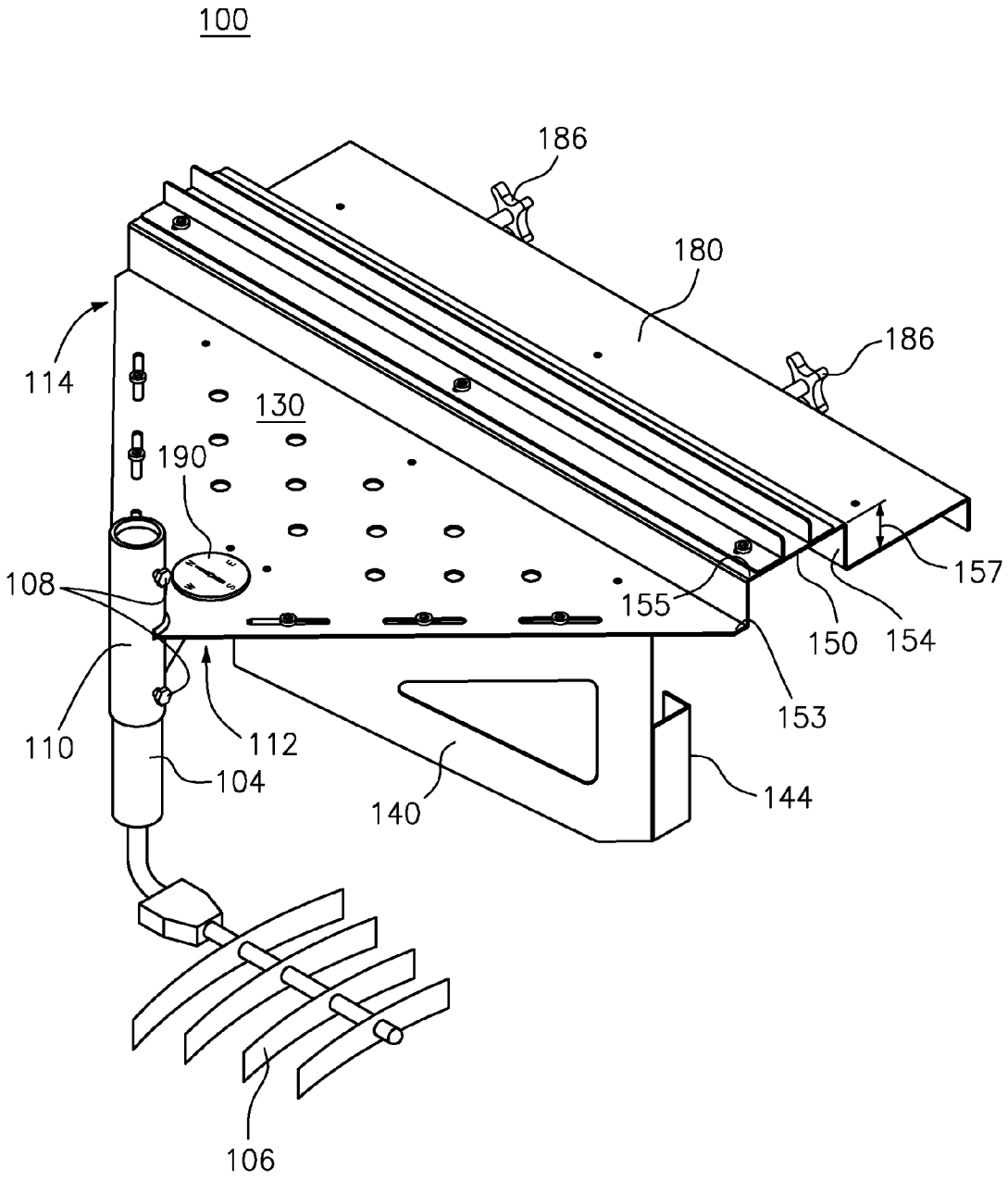
FIG. 1 is a perspective view of the antenna window bracket in accordance with the present invention, including an antenna mounted thereon in an inverted position.
Figure 3:
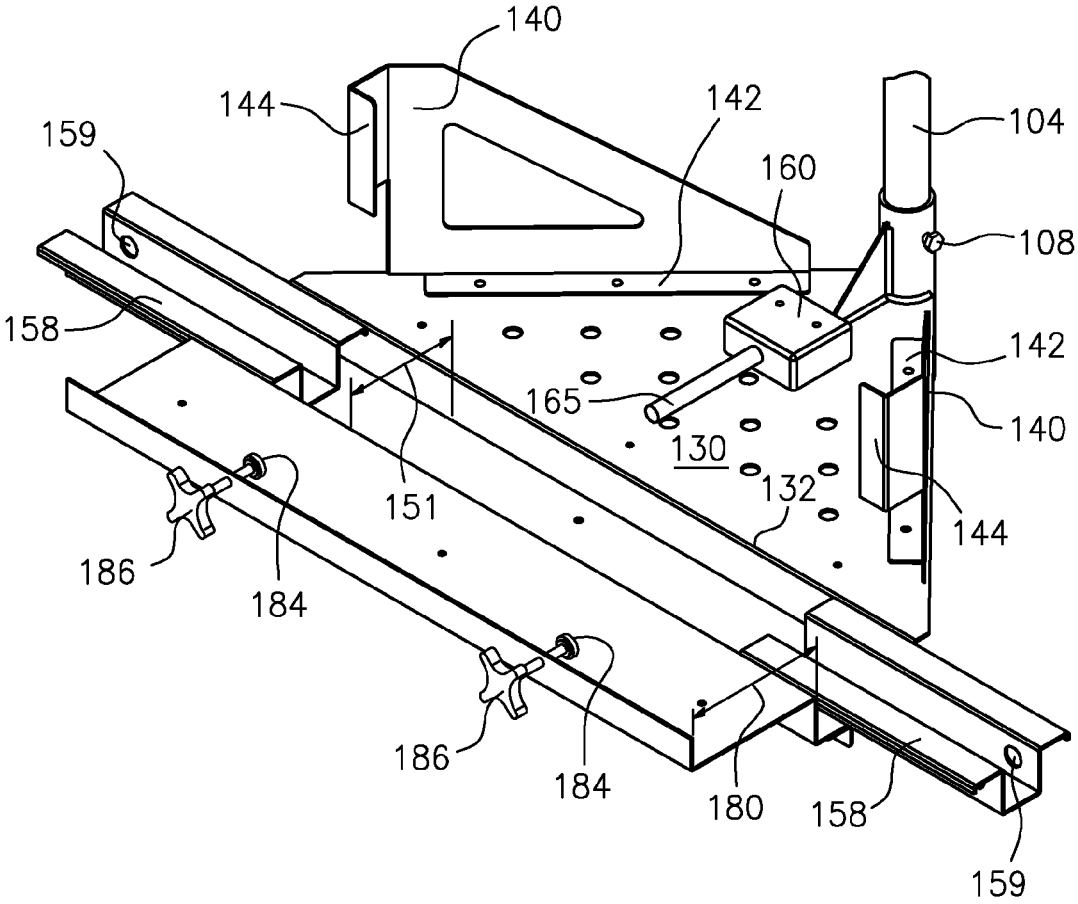
FIG. 3 is bottom view of the antenna window bracket of FIG. 1, with an antenna mast mounted thereon, further including bridge extensions.
Figure 4:
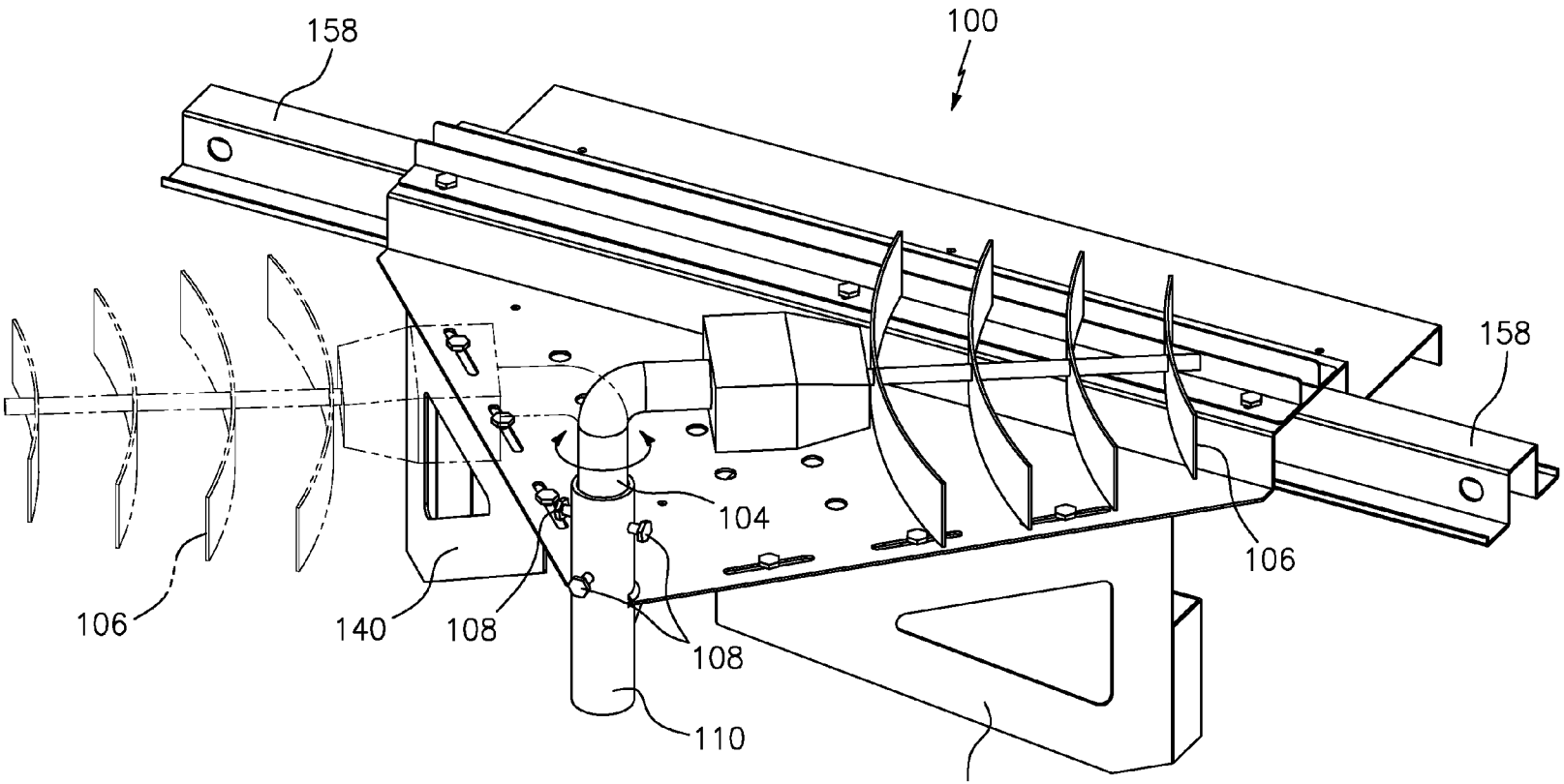
FIG. 4 is a front view of the antenna window bracket of FIG. 1, including bridge extensions and an antenna mounted thereon in varied upright positions.
Figure 5:
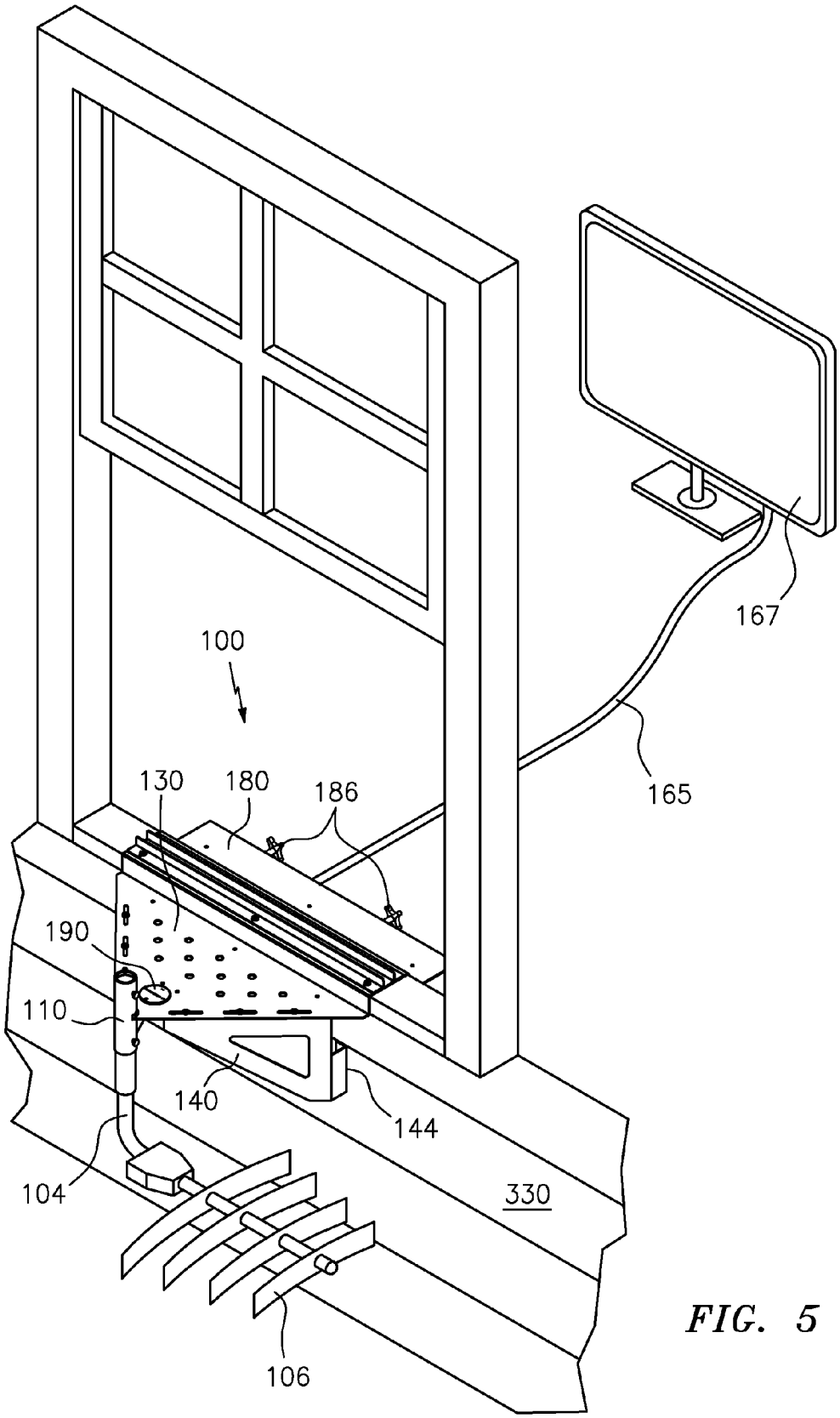
FIG. 5 is a perspective view showing the antenna window bracket positioned in a window of a dwelling supporting an antenna in the inverted position.

FIGS. 1-5 illustrate an antenna window bracket 100 that is mountable on a sill 320 portion of a window 300. As shown in FIGS. 1 and 5, antenna 106 is installed in an inverted position to provide an unobstructed view through window 300. As shown in FIGS. 1-5, the antenna bracket 100 preferably includes an extender 130 or external support plate that provides a surface that extends out from the window 300 in which the bracket 100 is installed.

Figure 2:
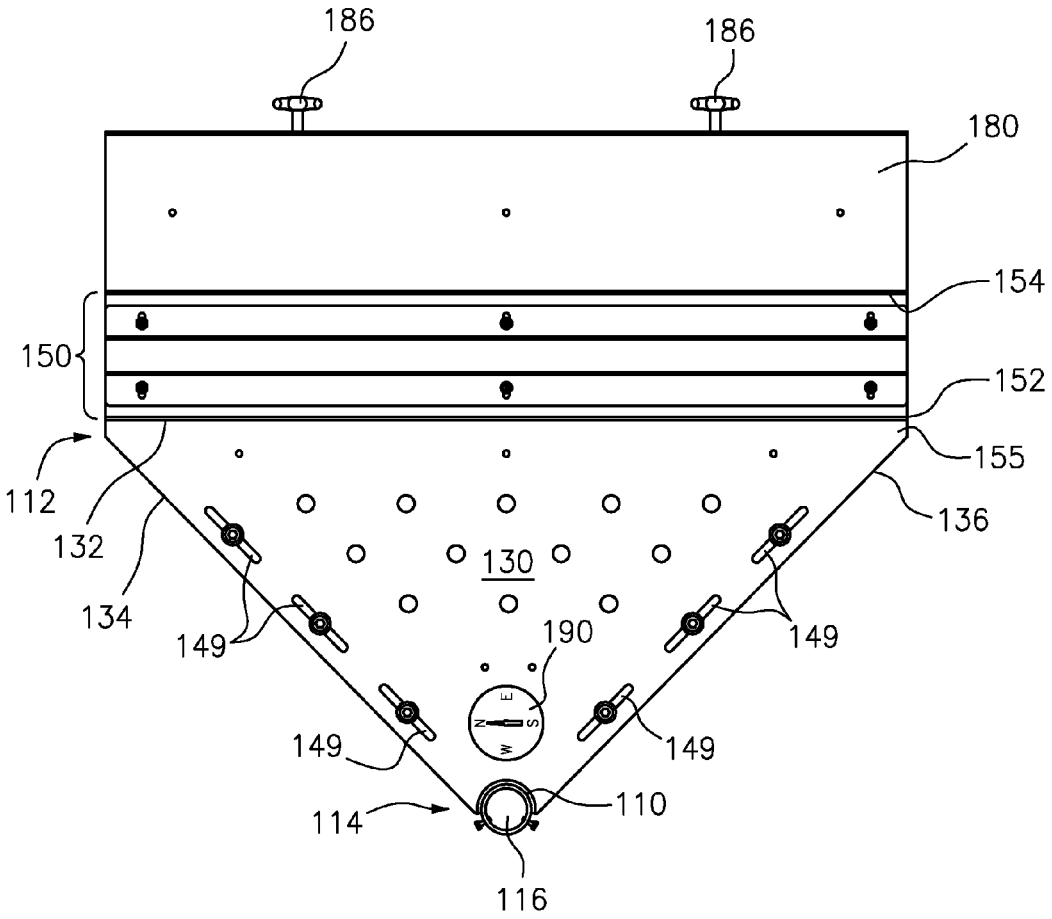
FIG. 2 is top view of the antenna window bracket of FIG. 1.

The extender 130 includes an antenna receiver 110, also referred to herein as a mast receiver, on a distal end 112 thereof. As shown in FIGS. 1 and 3-4, one or more mast locks are provided on antenna receiver 110, such as set screws 108, to fix an antenna mast 104 and position of antenna 106 in the mast receiver 110. The mast receiver 110 can be formed as a hollow tube 116, as shown in FIG. 2.

A rotation point is preferably provided to alternatively position antenna 106 in upright or inverse positions. For example, before installing the bracket 100, antenna 106 is affixed to the antenna mast 104, which is fixed in the mast receiver 110, with the antenna 106 in an upright position. When in the upright position, a user can easily pass the antenna bracket 100 with the antenna 106 through an open window 300, and secure the bracket 100 in the window 300, as described below. The user then remotely rotates the antenna 106 via operation of the rotation joint (not shown), preferably by releasing a safety release pin to allow the mast receiver 110 to rotate to an inverted position, in which the antenna 106 rests completely below the line of sight outside of the window 300 to avoid impairing visibility through window 300.

A compass 190 is preferably fixed on an upper side of the extender 130 in a position viewable by the user to facilitate exact directional positioning of antenna 106, thereby maximizing antenna reception.

The antenna bracket 100 includes a bridge 150 at a proximal end 114 of the extender 130. The bridge 150 includes an interior support 180 positioned opposite the proximal end 114 of the extender 130. The bridge 150 also preferably includes a pair of risers on an upper surface thereof that are widthwise adjustable to closely accommodate a bottom edge of the window when closed onto the bridge 150, thereby minimizing drafts.

Tighteners 184 (FIG. 3) are provided to engage and push against an interior portion of the sill 320 when tightener controllers 186 (FIGS. 1-3, 5) are operated to cinch a first bridge edge 152 (FIG. 2) against an outer vertical surface of sill 320, thereby forming an airtight seal to avoid energy loss when the window 300 is closed with the antenna bracket 100 in place. As shown in FIG. 2, the first edge 152 is preferably substantially parallel to a second bridge edge 154.

As shown in FIG. 3, a channel 151 is preferably provided between the first bridge edge 152 and the second bridge edge 154. As shown in FIG. 5, the channel 151 fits over a sill 320 of the window 300. In addition, as shown in FIGS. 3-4, a bridge extension 159 is preferably provided as a channel extender to act as an insulator to prevent draft and heat loss. A plurality of bridge extensions 159 are preferably provided of a narrower width to match the width of the sill 320, thereby stabilizing the antenna bracket 100 during installation and use with windows of varied dimensions.

A passage 159 is provided in the bridge extension 159 to accommodate the coaxial cable 165 to connect the antenna 106 to a television 167 (FIG. 5) or other user device. A balun 160 is preferably mounted on an underside of the extender 130 to protect the balun 160 from rain and other elements. The balun 160 provides an electrical connection between the antenna 106 and the television 167, with an electrical connection between balun 160 and television 167 preferably provided by a flat-type coaxial cable 165.

The antenna bracket 100 includes a plurality of extender supports 140, each having a first edge 142 and a second edge 144, which preferably are substantially perpendicular. As shown in FIG. 5, the second edge 144 abuts a surface 330 beneath a window 300 within which the bridge 150 is installed, thereby supporting the weight of various size antennas 106 mounted on distal end 112 of the extender 130. The second edge 144 of the extender support 140 is preferably provided with rubber non-marring pads to avoid damage to surface 330.

The extender 130 is preferably formed in a flat triangular shape, and preferably is fabricated of metal or composite material with high stiffness. As shown in FIG. 1, the extender 130 is provided at a first level 153 shared by the first bridge edge 152. The second bridge edge 154 is provided at a second level 155 separated from the first level 143 of the first edge 152 by a predefined elevation 157, which forms a depth of the channel 151, to facilitate ease of installation of the bracket 100 in window 300.

The triangular shape of extender 130 has three sides. As shown in FIG. 2, the first edge 152 of the bridge 150 is substantially parallel with a first side 132 of the extender 130. The second side 134 and the third side 136 of extender 130 support a first edge 142 of respective extender supports 140.

As shown in FIGS. 1-2 and 4-5, elongated slots 149 are preferably provided on the second side 134 and on the third side 136 of extender 130 to variably position the respective extender support 140, thereby allowing for accommodation of windows 300 that are recessed varied depths from the exterior building surface 330.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed:

1. A portable antenna bracket that does not damage a window in which the bracket is temporarily installed, comprising:

a flat triangular shaped extender positioned perpendicular to and beneath a window and having an antenna receiver on a distal end thereof;

a bridge at a proximal end of the extender;

an interior support of the bridge positioned opposite the extender, the interior support extending the width of an inner window sill;

two extender supports, wherein each extender support has a first edge and a second edge, with the second edge adapted to abut a surface beneath a window within which the bridge is installed to support the weight of an antenna, regardless of size or shape; and, wherein the antenna bracket allows positioning of an antenna beneath the window so as to not impede a line of sight of a building occupant out of the window.

2. The portable antenna bracket of claim 1, wherein the first edge and the second edge of the extender supports are substantially perpendicular, and the second edge comprises rubber non-marring pads.

3. The portable antenna bracket of claim 1, wherein the flat triangular shaped extender is provided at a first level, wherein the bridge includes a first edge provided at the first level and a second edge provided at a second level, wherein a predefined elevation separates the first level of the first edge from the second level of the second edge, and wherein the bridge includes a channel having a depth of the predefined elevation.

4. The portable antenna bracket of claim 3, wherein the first edge and the second edge of the bridge are substantially parallel.

5. The portable antenna bracket of claim 3, wherein a sill of the window is positioned in the channel of the bridge when the antenna bracket is installed in the window.

6. The portable antenna bracket of claim 3, wherein the flat triangular shaped extender has three sides, with the first edge of the bridge being substantially parallel to the first side of the extender, and second and third sides of the extender supporting respective first edges of the extender supports.

7. The portable antenna bracket of claim 5, further comprising elongated slots on the second side and on the third side of the extender to variably position respective extender supports.

8. The portable antenna bracket of claim 1, wherein the antenna receiver includes a hollow tube vertically positioned within which a mast of an antenna or satellite dish is mounted into the top or bottom of the hollow tube.

9. The portable antenna bracket of claim 8, wherein the hollow tube of the antenna receiver reversibly receives the antenna mast into the bottom of the hollow tube to position an antenna mounted therein beneath the sill of the window within which the bridge is installed.

10. The portable antenna bracket of claim 1, further comprising a balun mounted on the underside of the extender to provide an electrical connection between an antenna mounted in the antenna receiver and a television.

11. The portable antenna bracket of claim 10, wherein the electrical connection between the balun and the television is provided by a flat coaxial cable.

12. The portable antenna bracket of claim 10, further comprising a bridge extension that includes a passage for the coaxial cable.

13. The portable antenna bracket of claim 1, further comprising an antenna mast configured to be reversibly positioned within the antenna receiver.

14. The portable antenna bracket of claim 1, further comprising a compass fixed on the extender for directional positioning of an antenna rotatably attached to the antenna mast.

15. The portable antenna bracket of claim 1, further comprising tighteners on the interior support to tighten the first bridge edge on the window sill to create an airtight seal when the window is closed.

16. A portable antenna bracket comprising:

a flat triangular extender having an antenna receiver on a distal end thereof, wherein the antenna receiver includes a hollow tube within which a mast of an antenna or satellite dish is reversibly positioned so as to not impede a line of sight of a building occupant out of the window;

a bridge at a proximal end of the extender;

an interior support of the bridge opposite the extender, the interior support extending the width of an inner window sill;

two triangular shaped extender supports, wherein each of the extender supports have a first edge and a second edge, with the second edge adapted to abut a surface beneath a window within which the antenna bracket is positioned without damaging the surface.

17. The portable antenna bracket of claim 16, wherein the flat triangular extender is provided at a first level, wherein the bridge includes a first edge and a second edge, with the first edge provided at the first level and the second edge provided at a second level, and wherein a predefined elevation separates the first level of the first edge from the second level of the second edge.

18. The portable antenna bracket of claim 16, wherein the antenna receiver reversibly receives the antenna mast by receiving the antenna into the bottom of the hollow tube or by receiving the antenna into the top of the hollow tube and rotating the tube.

19. The portable antenna bracket of claim 16, further comprising tighteners on the interior support to tighten the first bridge edge on the window sill to create an airtight seal when the window is closed.

20. The portable antenna bracket of claim 16, the bridge further comprising on a bridge upper surface a pair of vertical risers widthwise adjustable to accommodate a bottom edge of the window.

* * * * *